US008978394B2

(12) United States Patent
Koldewey et al.

(10) Patent No.: US 8,978,394 B2
(45) Date of Patent: Mar. 17, 2015

(54) CONVERTIBLE REFRIGERANT RECOVERY, RECYCLE, AND RECHARGE SYSTEM

(75) Inventors: Richard Koldewey, Auburn, IN (US); Jose Sacerio, Hialeah, FL (US); Juan Saluzzio, Miami, FL (US)

(73) Assignee: CPS Products, Inc., Hialeah, FL (US)

( * ) Notice: Subject to any disclaimer, the term of this patent is extended or adjusted under 35 U.S.C. 154(b) by 443 days.

(21) Appl. No.: 13/528,964

(22) Filed: Jun. 21, 2012

(65) Prior Publication Data

US 2013/0340447 A1 Dec. 26, 2013

(51) Int. Cl.
*F25B 45/00* (2006.01)

(52) U.S. Cl.
CPC ..... *F25B 45/00* (2013.01)
USPC ..... 62/77; 62/149

(58) Field of Classification Search
USPC ..... 62/77, 85, 127, 149, 195, 292, 475
See application file for complete search history.

(56) References Cited

U.S. PATENT DOCUMENTS 3,699,781 A * 10/1972 Taylor ..... 62/474
5,095,713 A * 3/1992 Laukhuf et al. ..... 62/149
5,161,385 A 11/1992 Schumacher
5,193,351 A * 3/1993 Laukhuf et al. ..... 62/77
5,211,024 A * 5/1993 Manz et al. ..... 62/126
5,282,366 A 2/1994 Reilly, Jr. et al.
5,325,675 A * 7/1994 Manz et al. ..... 62/77
5,353,603 A * 10/1994 Outlaw et al. ..... 62/149
5,548,966 A 8/1996 Tinsler
5,603,223 A 2/1997 Murray et al.
5,606,862 A 3/1997 Peckjian et al.
6,314,749 B1 11/2001 Van Steenburgh, Jr.
6,591,629 B1 7/2003 Galbreath, Jr.
6,871,511 B2 * 3/2005 Okaza et al. ..... 62/498
2008/0229774 A1 9/2008 Jeffers et al.

FOREIGN PATENT DOCUMENTS

CN 201539382 8/2010

* cited by examiner

*Primary Examiner* — Melvin Jones
(74) *Attorney, Agent, or Firm* — Malin Haley DiMaggio & Bowen, P.A.

(57) ABSTRACT

A convertible refrigerant recovery, recycle, and recharge unit, comprising a control valve array, a vacuum pump, an oil separator, an oil-less compressor, and one or more storage tanks. The vacuum pump and the oil separator are in flow communication with the control valve array, the oil-less compressor is in flow communication with the oil separator, and the storage tanks are in flow communication with said oil-less compressor. The control valve array receives refrigerant from a refrigerant containing device wherein the oil-less compressor draws the refrigerant into said the storage tanks. The unit is compatible with a plurality of refrigerant types without cross-contamination of the refrigerant due to the oil-less compressor and conversion cycle whereby the vacuum pump is activated to remove residual refrigerant from the unit. A refrigerant identifier sensor is in flow communication with the system and can detect contaminants and selectively open and close the storage tanks.

16 Claims, 4 Drawing Sheets

CONVERTIBLE REFRIGERANT RECOVERY, RECYCLE, AND RECHARGE SYSTEM

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to refrigerant recovery, recycle, and recharge (R/R/R) units and more specifically to an R/R/R unit incorporating an oil-less compressor.

2. Description of Related Art

In 1992, the United States EPA set up regulations requiring the capture (recovery) of all refrigerants from commercial and automotive refrigerant containing systems. Refrigerant Recovery, Recycle, and Recharge equipment (commonly referred to as R/R/R Equipment) has been designed for use on Commercial and Automotive Refrigerant containing systems. Since it is illegal to vent CFC, HCFC, HFC and HFO type refrigerants into the atmosphere, equipment has been developed to recovery, recycle, evacuate, flush, and/or recharge these refrigerants. The equipment can perform one or more of these functions. Some of the more common refrigerants serviced in the mobile Air Conditioning and refrigeration markets are R-12, R-22, R-134a, R-152a, R-404a, R-500, R-502 and R-407C.

Commercially available refrigerant recovery units, which are preferably brought on-site, typically consist of some combination of a recovery compressor, air-cooled condenser, and a fan from which compressed and condensed refrigerant is sent to a collection tank. These refrigerant recovery units are often times configured to recover a wide variety of refrigerants including R-12, R-22, R-134a, R-404a and R-410A among others. In the case of these multi-refrigerant R/R/R machines, single circuit and dual circuit have been utilized. Dual-circuit machines are typically not convertible but rather provide two dedicated refrigerant R/R/R circuits whereby the user selects which refrigerant circuit to utilize. Typically, a dual-circuit system is used to handle two types of refrigerants in order to avoid cross-contamination and is not convertible in any respect; the user selectively engages the circuit that he wishes to employ. Each circuit in a dual-circuit system typically includes each of a compressor, condenser, fan, and tank.

Single-circuit units, on the other hand, employ a conversion process which allows the system to clear out residual refrigerant from a first process before switching over to a different refrigerant in a second process. Many of these single-circuit systems employ oil-filled compressors and filter driers which oil and filter drier desiccant will absorb and hold residual refrigerant absent some cleaning or conversion process. Failure to properly clear out a system will lead to cross contamination of refrigerants and lead to equipment failure. Thus, without an adequate conversion process or the availability of a second circuit, cross-contamination will occur, ultimately leading to equipment damage and failure. On solution, however, is to provide a "recovery-only" unit when dealing with contaminated refrigerant. This allows for the recovery, i.e. capture and storage, process only and will not provide for the recharging or recycling of usable refrigerant back into the system or into another system. Thus, these "recovery-only" systems are limited in use.

There have been several attempts at providing single-circuit multi-refrigerant R/R/R units, however none have adequately addressed the trapped residual refrigerant found in the compressor oil and the filter drier desiccant. For example, the U.S. Pat. No. 5,161,385 to Schumacher describes a refrigerant recovery system that stores and processes the recovered refrigerant in a vapor phase at low pressure and ambient temperatures. The system removes oil, moisture, air and other contaminants from the recovered refrigerant. However, the system relies on the compressor of the refrigerant system being serviced to send the refrigerant out, known as passive refrigerant recovery. Accordingly, if the system being serviced is not operational, the invention cannot work.

U.S. Pat. No. 5,211,024 to Manz et al. describes an apparatus for the purification of a single refrigerant type utilizing a filter/drier unit for removing water from refrigerant passing therethrough. A refrigerant pump, such as a compressor, pumps refrigerant from equipment under service. An oil separator is provided at the outlet of the compressor to remove oil from the processed refrigerant. The refrigerant exits the oil separator and passes through a condenser before it is stored as a liquid in a storage tank. The oil separator must be placed post-compressor in order to remove oil from the refrigerant. However, residual refrigerant will still be retained in the oil sump of the compressor as well as in the oil separator.

U.S. Pat. No. 5,282,366 to Reilly, Jr. et al. describes a hand-transportable unit for transferring refrigerants between containers including a pump, a condenser, and a compressor which operates the pump. The compressor utilized is an air compressor configured to as a pump driving means to operate the pump, which pumps drives the refrigerant from a refrigerant source, through a compressor, and into a storage tank. However, the system provide no means to clear refrigerant from the oil and residual refrigerant will remain in the system after use.

U.S. Pat. No. 5,325,675 to Manz et al. describes a refrigerant recovery system including a compressor having an inlet and an outlet, and an oil separator connected to the compressor inlet for separating oil from refrigerant recovered from equipment under service. A check valve is connected between the outlet port of the separator and the inlet of the compressor for feeding refrigerant directly to the compressor inlet. Pressure sensors are located throughout the system to monitor the refrigerant pressure. A second oil separator may be located post-compressor to remove any additional oil contaminants in the refrigerant after compression. Again, the use of the oil separator in the post-compression stage indicates the existence of residual refrigerant in the oil sump and in the separator after use.

U.S. Pat. No. 5,548,966 to Tinsler describes a refrigerant recovery system having a closed-loop refrigeration system employing a portable storage tank to recover refrigerant from a separate system that needs servicing. A storage tank within an evaporator is cooled by evaporator coils and evacuated by a vacuum pump. The pump is valved off and recovered refrigerant is directed to the storage tank from the separate system. The system assures that none of the recovered refrigerant contacts the compressor of the recovery system and vacuum pump. The system therefore assures that the containments recovered by the recovery system do not come into contact with the recovery compressor, it requires two separate circuits whereby the first is shut off before the second is turned on. These added complexities are undesirable from a cost and maintenance standpoint.

U.S. Pat. No. 6,603,223 to Murray et al. describes refrigerant handling system having a refrigerant compressor with inlet for connection to a refrigerant source to be recovered and an outlet for connection to a refrigerant storage container. A separator is connected in series with the compressor for separating lubricant from refrigerant either before or after passage of the refrigerant through the compressor. A valve is connected between the inlet and the outlet of the compressor for equalizing pressure across the compressor during non-operation. While simple and useful, the need for the oil separate assures that residual refrigerant will remain in the oil sump, separator and other components after use.

Consequently, there is a marked need for single-circuit refrigerant R/R/R unit that does not allow for the build up or recirculation of residual refrigerant after use such that the unit can convertibly handle a plurality of different refrigerants without the need for servicing. It is, therefore, to the effective resolution of the aforementioned problems and shortcomings of the prior art that the present invention is directed. However, in view of the heat exchanger systems in existence at the time of the present invention, it was not obvious to those persons of ordinary skill in the pertinent art as to how the identified needs could be fulfilled in an advantageous manner.

SUMMARY OF THE INVENTION

The present invention provides a convertible refrigerant recovery, recycle, and recharge unit, comprising a control valve array, a vacuum pump, an oil separator, an oil-less compressor, and one or more storage tanks. The vacuum pump and the oil separator are in flow communication with the control valve array, the oil-less compressor is in flow communication with the oil separator and the one or more storage tanks are in flow communication with said oil-less compressor. The control valve array is adapted to receive refrigerant from a refrigerant containing device wherein the oil-less compressor draws the refrigerant into said one or more storage tanks.

The R/R/R unit is compatible with a plurality of refrigerant types without cross-contamination of said refrigerant due to the oil-less compressor and conversion cycle whereby the vacuum pump is activated to remove residual refrigerant from the unit. The oil separator removes contaminants from the refrigerant before passing the refrigerant to the oil-less compressor, resulting in clean refrigerant recovery. In some embodiments, the storage tanks comprise a primary storage tank and a contaminated refrigerant storage tank which are selectably operable. A refrigerant identifier sensor can detect contaminants in the refrigerant and, if contaminants are detected, can selectively close the primary storage tank and selectively open the contaminated refrigerant storage tank.

In some embodiments, the refrigerant identifier sensor is in communication with one or more valves on each of the one or more storage tanks in order to control the opening and closing thereof. The control valve array comprises one or more valves to control the flow of refrigerant to the vacuum pump, the oil separator, the oil-less compressor, and the one or more storage tanks. A pressure sensor may be in communication with the valves and adapted to control the valves based on detection of pressure. In some embodiments, the pressure sensor is further in communication a vacuum pump valve in flow communication with he vacuum, wherein he pressure sensor is configured to activate he vacuum pump valve such that the vacuum pump removes residual refrigerant from the unit, converting it for use with another refrigerant.

Accordingly, it is an object of the present invention to provide a refrigerant R/R/R unit that allows for the recovery of multiple refrigerant types without the risk of cross-contamination.

It is another object of the present invention to provide a refrigerant R/R/R unit that incorporates an oil-less compressor to eliminate the possibility that contaminates remain trapped in the compressor and contaminate refrigerant passing through the unit.

It is another object of the present invention to provide a refrigerant R/R/R unit that incorporates a vacuum pump in order to remove residual refrigerant from the system after a recovery procedure in order to convert the unit for use with another refrigerant.

In accordance with these and other objects which will become apparent hereinafter, the instant invention will now be described with particular reference to the accompanying drawings.

DETAILED DESCRIPTION

Figure 1:
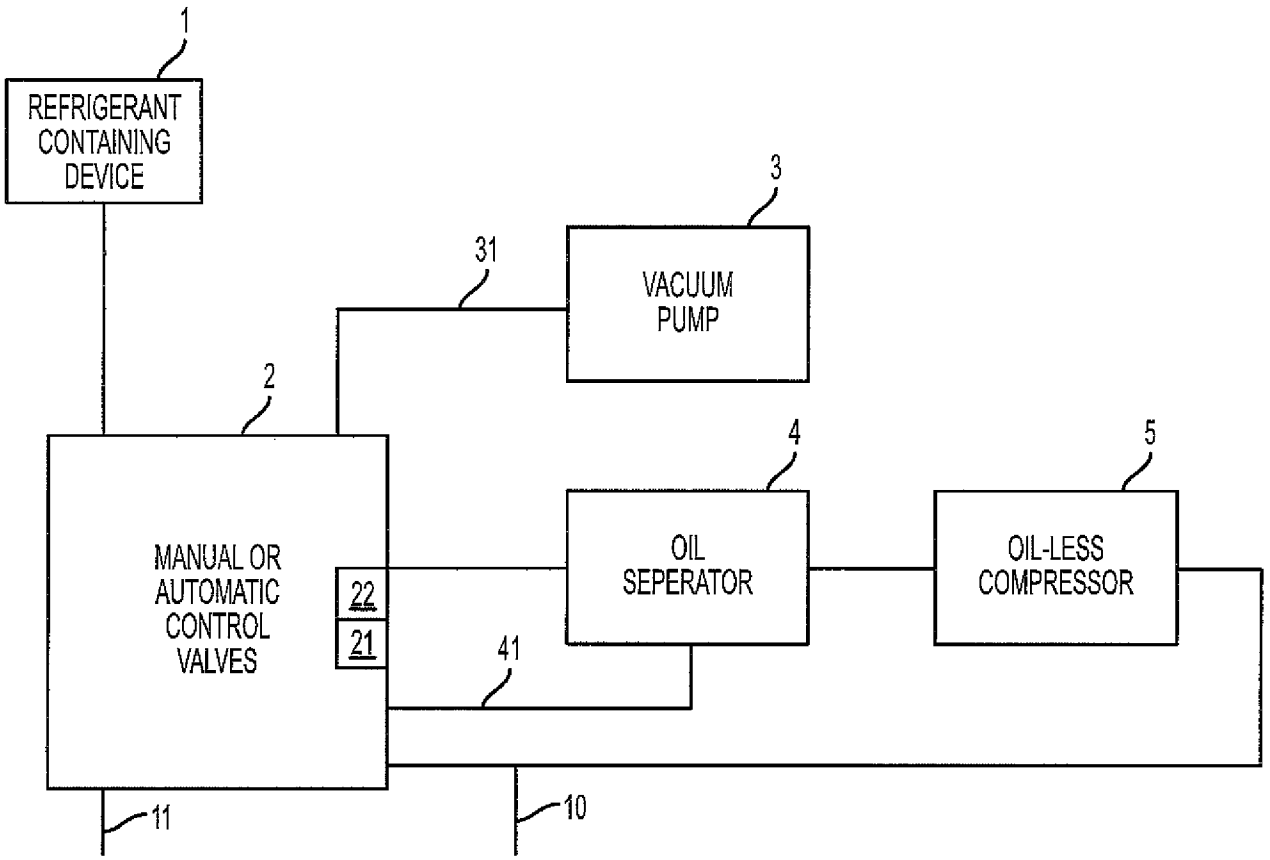
FIG. 1 is a schematic of one embodiment of the convertible refrigerant recovery, recycle, and recharge system in accordance with the present invention.

The present invention contemplates various embodiments of a single circuit convertible R/R/R/ unit based around an oil-less compressor. For purposes of this disclosure R/R/R unit is used as short-hand for a unit or system capable of recovering, recycling, and recharging refrigerant-containing systems such as HVAC unit, refrigerators, automotive AC systems, and the like. FIG. 1 is a schematic of a basic embodiment of the system of the present invention. Shown is the R/R/R unit comprising a refrigerant containing device 1, an array of control valves 2, a vacuum pump 3, an oil separator 4, and an oil-less compressor 5. The refrigerant containing device 1 may comprise a refrigerator, an HVAC system (heating, ventilation and air conditioning system), an automotive air conditioning unit, or any other like device containing a refrigerant. As shown, an outlet of the refrigerant containing device is connected externally to the control valve array 2. The control valve array 2 comprises one or more manual or automatic valves and attendant fittings and plumbing which are provided to control and permit refrigerant flow through the various inputs and outputs of the R/R/R unit of the present invention. In some embodiments, the valves may be electromechanical such as the valves described in U.S. Pat. No. 8,082,750 entitled "Device for Automatic Processing of Contaminated Refrigerant from an Air Conditioning System" which patent is incorporated by reference herein in its entirety. In other embodiments, the valves may comprise manual valves or automatic solenoid valves known in the art.

Vacuum pump 3 is in flow communication with the control valve array 2 such that it creates a vacuum and suction within the control valve array 2 in order to draw refrigerant from all of the components in the R/R/R unit for removal of residual refrigerant after a given operation. Oil separator 4 is also in flow communication with control valve array 2 and compressor 5 is further in flow communication with the oil separator. The compressor 5 may be an electric or internal combustion driven compressor which is utilized to create a pressure differential across the R/R/R unit during a recovery, recycling, flushing, tank refill or recharge operation. The compressor will suck refrigerant from the refrigerant containing device through the system, compress it, and send it off into a storage tank and further described below.

As a result of the suction created by compressor 5, refrigerant is drawn from refrigerant containing device 1, through control valve array 2, and into the input of the oil separator 4. Oil separator 4 is provided in order to remove oil, acid, particles and other contaminants from the refrigerant existing the refrigerant containing device. Often these contaminants include oil remaining in the refrigerant as a result of a previous charging or recharging procedure wherein an oil-containing compressor was utilized. Next, the oil-free refrigerant is passed from the oil separator 4 to the oil-less compressor 5. Accordingly, the oil separator 4 is disposed between the control valve array 2 (and hence the refrigerant containing device 1) and the oil-less compressor 4. The oil-less compressor 5 compresses the refrigerant and passes the compressed refrigerant along to primary outlet 10. In some embodiments, the compressed refrigerant will pass back through the control valve array 2 and then through secondary outlet 11. One or both of the outlets 10 and 11 may be utilized, as shown and described below.

Figure 2:
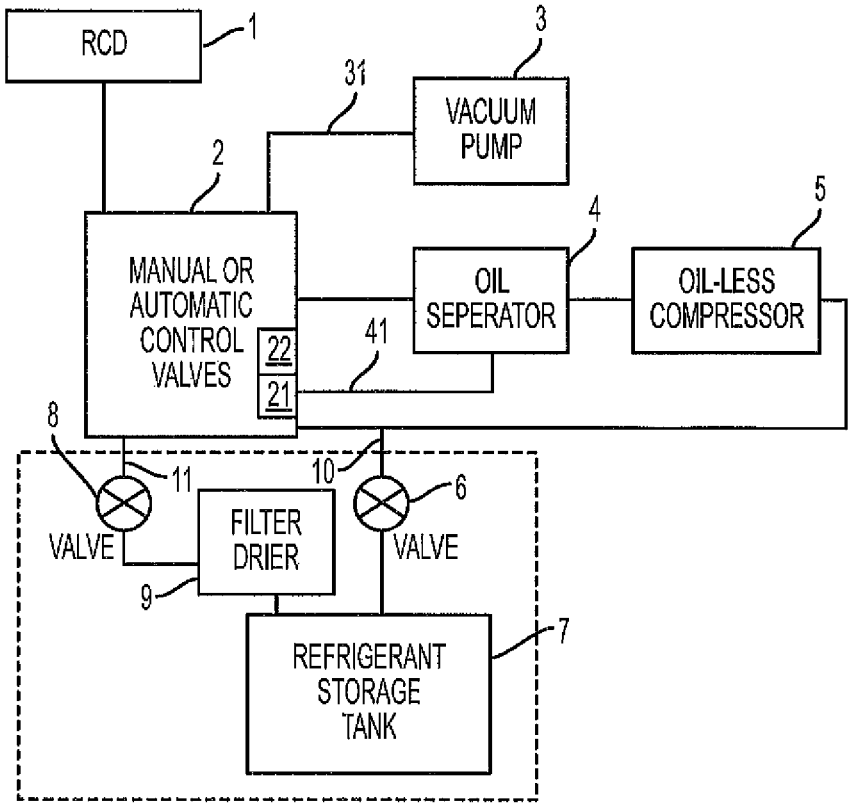
FIG. 2 is a schematic of another embodiment of the convertible refrigerant recovery, recycle, and recharge system in accordance with the present invention shown in flow communication with a storage tank.
Figure 3:
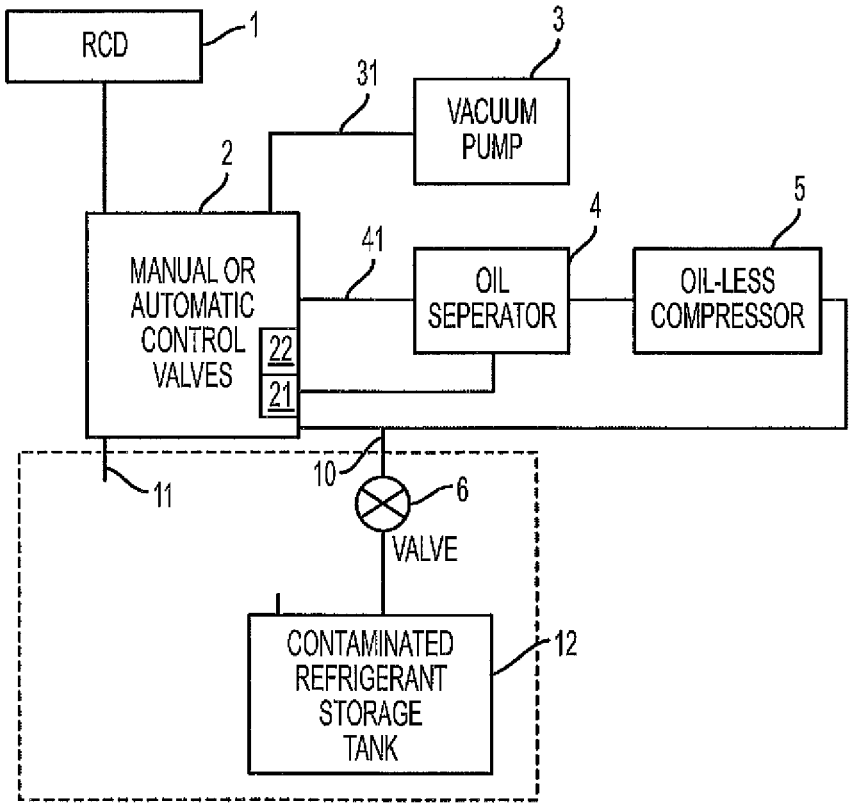
FIG. 3 is a schematic of another embodiment of the convertible refrigerant recovery, recycle, and recharge system in accordance with the present invention shown in flow communication with a contaminated refrigerant storage tank.

Various embodiments of the present invention allow the unit to pass recovered compressed refrigerant to a plurality of storage tank configurations, depending on the desired design. With reference to FIGS. 2 and 3, two storage tank options are provided. In FIG. 2, shown is an embodiment of the R/R/R unit of the present invention configured for multi-refrigerant usage without the possibility of cross-contamination of refrigerants. As shown, the refrigerant passes through the circuit shown in FIG. 1 and described above and the compressed refrigerant exits the oil-less compressor as usual. The refrigerant passes through primary outlet 10, through a tank valve 6 and into a refrigerant storage tank 7. The refrigerant storage tank is further in flow communication with a filter drier 9, which is further in flow communication with a filter valve 8 and control valve array 2. The filter drier can be permanently mounted to the storage tank 7, although it need not be. At the completion of a recovery, recycle, or recharge operation, the vacuum 3 can be activated, which pulls any residual refrigerant from the components of the unit, effectively cleaning the system for a subsequent operation. This final vacuum action may be referred to as the "conversion process" wherein the unit is prepared for another R/R/R operation for a different refrigerant without the need to provision another R/R/R unit.

The present invention enables a single circuit machine to be convertible for use with multiple refrigerants without the possible of cross-contamination, particularly due to the use of the oil-less compressor and the vacuum removal process. Contaminants in the refrigerant taken from the refrigerant containing device are cleaned by the oil separator, which is pre-compressor. The oil-free refrigerant is then compressed and stored in the refrigerant storage tank, then the vacuum is activated for final preparation for another procedure. When the R/R/R unit is connected to another refrigerant containing device 1, containing a different refrigerant, a new storage tank 7 may be provided and the system can operate normally without the risk of cross-contamination because the oil-less compressor is not retaining contaminants.

In FIG. 3, shown is an embodiment of the R/R/R unit of the present invention configured for recovery and storage of a contaminated refrigerant. As shown, contaminated refrigerant exiting the oil-less compressor 5 passes through tank valve 6 and into contaminated storage tank 12. This configuration is useful where it is known that the refrigerant from the refrigerant containing device 1 is in fact contaminated and that the oil separator will be adequate enough to remove all contaminants. However, because the oil-less compressor 5 does not use oil as a lubricant or contain an oil sump, none of the contaminants from the refrigerant will remain in the compressor and therefore the R/R/R unit can be utilized in subsequent operations without the need to flush the system. In some embodiments, the vacuum 3 is activated at the conclusion of the recovery, recycling, or recharging process in order to remove any residual contaminated refrigerant.

Figure 4:
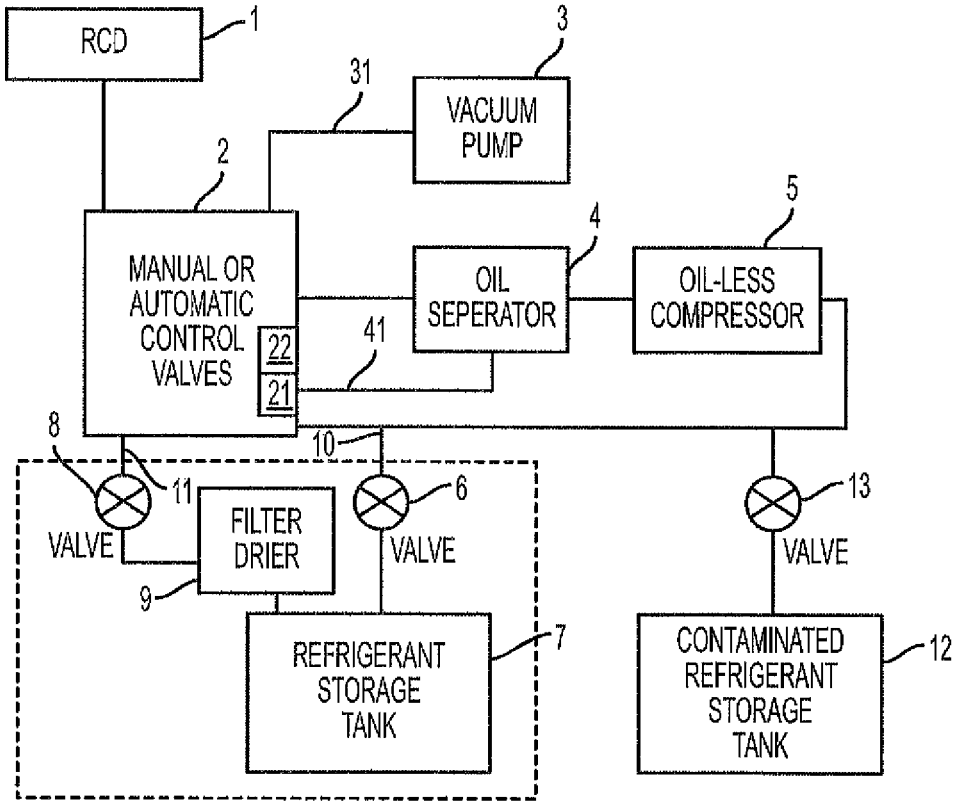
FIG. 4 is a schematic of another embodiment of the convertible refrigerant recovery, recycle, and recharge system in accordance with the present invention shown in flow communication with a first storage tank and a second contaminated refrigerant storage tank.

With reference to FIG. 4 shown is another embodiment of the present invention providing a single circuit R/R/R unit that is convertible for use with multiple refrigerants and is able to selectively transfer preexisting contaminated refrigerant into a separate storage tank without contaminating a primary storage tank or any of the components of the system. Shown again are the basic components including a refrigerant containing device 1 providing refrigerant into the control valve array 2 wherein the control valve array 2 is in flow communication with a vacuum pump 3 for cleaning and an oil separator 4 and then oil-less compressor 5 for suction and compression of refrigerant. The output of the oil-less compressor is in flow communication with a contaminated tank valve 13, tank valve 6, and filter drier valve 8.

In some embodiments, the control valve array 2 may comprise one or more refrigerant identifier sensors 21 adapted to detect contaminants in the refrigerant being suctioned from the refrigerant containing device 1. If contaminants are detected, tank valve 6 and filter valve 8 are automatically or manually shut off and contaminated tank valve 13 is opened, such that the contaminated refrigerant passing through the system reaches only the contaminated refrigerant storage tank 12. If the one or more sensors 21 in the control valve array 2 do not detect contaminants in the refrigerant being introduced into the system, then at least the tank valve 6 is manually or automatically opened and the contaminated tank valve 13 is manually or automatically closed, thus allowing the "clean" compressed refrigerant to enter the storage tank 7. In some embodiments, a sensor 21 need not be used to selectively engage the valves depending on the detection of contaminants. Rather, the existence of contaminants may be detected manually or simply be observed, in which case the user can selectively engage and disengage the appropriate valves, by manual or automatic means, in order to open and close the appropriate storage tank. Further, in some embodiments, following a recovery operation, vacuum pump 3 may be activated to clear the system out prior to another operation; this is particularly important when a contaminated refrigerant recovery process has been carried out. The refrigerant identifier sensor 21 does not have to be integrated with the control valve array 2, however it may be for preferred routing of the plumbing and for easier service, In some embodiments, the sensor 21 is located pre-compressor in order to detect contaminants in the recovered refrigerant just before it reaches the storage tanks. The control valve array 2 can also allow the sensor 21 to be located in a post-compressor position.

In some embodiments of the present invention, the control valve array 2 may further comprise a pressure switch/sensor 22 that is in communication with the various valves of the system such that pressure and other information may be communicated to the valves and may further activate the valves depending on the pressure or other detected information. The pressure switch/sensor 22 may work in combination with the refrigerant identifier sensor 21 to activate the various valves in an automated fashion. It is appreciated that the refrigerant identifier sensor 21 and pressure sensor 22 are in flow communication with the system and need not necessarily be integrated into the control valve array 2. The sensor 22 may be configured as a pressure transducer to monitor the pressure of a refrigeration containing device 1 that is being recovered to help determine when the recovery process is complete. The sensor 22 configured as pressure transducer can further be used to monitor vacuum levels or pressure levels in the service hoses to determine if leaks exist in the refrigeration system being serviced. This is done by pressure decay for a set period of time. The sensor 22 configured as pressure transducer can further be used to monitor the liquid pressure in the storage tanks to determine if non-condensable gas purging is required. The sensor 22 configured as pressure transducer can further be used to monitor refrigerant pressure levels in the entire R/R/R circuit during the conversion process. Once the residual refrigerant has been brought down to atmospheric pressure, the vacuum pump would then start and pull the remaining residuals out of the unit. The vacuum pump would run until the pressure transducer meets the required vacuum level.

In some embodiments, a vacuum pump valve 31 may be disposed between the vacuum pump inlet and the control valve array 2 and aids in the deep vacuum of the entire system. It can also provide a means to control the suction pressure generated by the vacuum pump 3 during the final conversion/preparation stage following a recovery, recycle, or recharge procedure. The vacuum pump valve 31 may optionally be integrated into control valve array 2 and further valve 31 may in communication with refrigerant identifier sensor 21 such that at the conclusion of the recovery of a contaminated refrigerant, the vacuum pump 3 is automatically activated in order to vent any and all remaining contaminated refrigerant from the system. In some embodiments, the vacuum pump valve 31 is further in communication with the pressure sensor 22 such that it controls the operation of the vacuum pump 3, for example, but shutting off the vacuum pump 3 once the pressure sensor 22 detects the required vacuum, i.e. pressure, level.

In some embodiments, a purge valve 41 may be disposed between the low side of the oil separator 4 and high side of control valve array 2. The purge valve 41 provides multiple functions including allowing the user to open the purge valve and purge non-condensable gases (NCG's) from the R/R/R storage tank, which may be required to maintain purity standards on the stored refrigerant. The user can also open the purge valve to use a refrigerant with higher amounts of NCG's to help drain recovered oil in the oil separator after the recovery cycle. Using this "waste" gas minimizes loss of good refrigerant. The purge valve can also be opened to provide a passage way between the low side and high side of the unit to allow venting of the trapped residual gases left in the unit during the conversion process. This passage way also communicates with the vacuum pump 3 (via other valves in the control valve array 2) for a final deep vacuum to remove all remaining refrigerant vapors from the entire R/R/R unit.

The configuration of the present invention provides a substantial improvement over the prior art in several respects. Firstly, the present invention eliminates the possibility of cross-contamination when dealing with multiple refrigerant containing units and multiple refrigerants. The present invention therefore makes it possible for one R/R/R machine to be used to service both R134A and HF01234 systems, among other combinations of refrigerants. In turn, the present invention provides an R/R/R unit that can service standard automotive AC systems as well as commercial refrigeration systems containing R22, R407 and a plurality of other refrigerants, contaminated or otherwise, all by way of a single recovery unit.

The use of an oil-less compressor in a convertible R/R/R unit's refrigeration circuit eliminates refrigerant to oil contact normally contributed to an oil filled compressor. The commonly used oil filled compressor injects oil into its cylinder(s) for lubrication, resulting in a refrigerant/oil mixture leaving the compressor discharge. The discharged oil needs to be recovered/separated from the refrigerant and returned to the oil filled compressor sump for future compressor lubrication. Failure to do this will lead to seized or damaged compressors. Failure to remove the oil will also affect the required purity of the recycled refrigerant. Additional refrigerant contact occurs in the oil sump of an oil filled compressor. Although most of the refrigerant can be separated from the oil during recovery, this process can be lengthy and makes cross contamination of the refrigerants likely as oil can trap refrigerant molecules even under a deep vacuum. Oil-filled compressors known in the art utilize an oil sump in which the refrigerant molecules can be trapped. Since no oil in present in the oil-less compressor utilized in the present invention, the oil contact due the compressor is eliminated. Thus there is no need for a compressor oil return system which utilizes a discharge oil separator. Thus residual refrigerant is quickly removed from the R/R/R refrigeration circuit during a conversion process by way of vacuum pump 3 and the possibility of cross contamination is eliminated.

The use of an oil-less compressor eliminates the need for a compressor discharge oil separator after the compressor as stated above. Removing the oil separator eliminates an unknown factor when determining/calculating the amount of refrigerant recovered because typically a discharge oil separator has a large volume which contains a mixture of oil, vapor and liquid refrigerant. The oil separator requires the use of a large volume vessel to slow down the flow of the refrigerant to which oil separation can be performed. At different conditions the amount of refrigerant in this vessel will vary. Thus the unknown amount of refrigerant is in the discharge oil separator will cause an error in the recovered refrigerant amounts. Because recovery accuracy is a good tool on determining if a refrigeration system maintained its refrigerant charge, the elimination of a post-compressor oil separator as in the present invention provides a substantial improvement over the prior art.

Further still, the provision for a removable and replaceable storage tank with dedicated refrigerant filter driers provides enhanced functionality. In the prior art, the conversion process requires the user to completely remove the storage tank (where the refrigerant is stored), attached tank hoses and attach a filter drier. In the present invention, however, in some embodiments, the filter drier is placed on the liquid source of the tank and is to remain with that specific refrigerant/tank assembly. If the conversion process was to include the evacuation of the drier, extra time and the possibility of trapped refrigerant and oil can occur. It is common with the use of oil filled compressors to permanently affix a filter drier on the suction side of the compressor for moisture protection. Mixing moisture and oil in an oil filled compressor can create a mild acidic solution which will attack the hermetically sealed motor windings. However, in the present invention, the oil-less compressor does not require a filter drier for moisture protection since the motor windings are not located in the refrigerant pathway and enables a rapid changeover from one refrigerant to another.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A convertible refrigerant recovery, recycle, and recharge unit, comprising:

a control valve array, a vacuum pump, an oil separator, an oil-less compressor, and one or more storage tanks;

said vacuum pump and said oil separator in flow communication with said control valve array;

said oil-less compressor in flow communication with said oil separator;

said one or more storage tanks in flow communication with said oil-less compressor; and wherein said control valve array is adapted to receive refrigerant from a refrigerant containing device;

wherein said oil-less compressor draws said refrigerant into said one or more storage tanks; and wherein said unit is compatible with a plurality of refrigerant types without cross-contamination of said refrigerant.

2. The unit of claim 1, wherein said vacuum pump is activated to remove residual refrigerant from said unit.

3. The unit of claim 1, wherein said oil separator removes contaminants from said refrigerant before passing said refrigerant to said oil-less compressor.

4. The unit of claim 1, wherein said storage tanks comprise a primary storage tank and a contaminated refrigerant storage tank.

5. The unit of claim 4, further comprising a refrigerant identifier sensor adapted to detect contaminants in said refrigerant and, if contaminants are detected, selective close said primary storage tank and selectively open said contaminated refrigerant storage tank.

6. The unit of claim 5, wherein said refrigerant identifier sensor is in communication with one or more valves on each of said one or more storage tanks in order to control the opening and closing thereof.

7. The unit of claim 1, wherein said control valve array comprises one or more valves to control the flow of refrigerant to said vacuum pump, said oil separator, said oil-less compressor, and said one or more storage tanks.

8. The unit of claim 7, further comprising a pressure sensor in communication with said valves and adapted to control said valves based on detection of pressure.

9. The unit of claim 8, wherein said pressure sensor is further in communication a vacuum pump valve in flow communication with said vacuum, wherein said pressure sensor is configured to activate said vacuum pump valve such that said vacuum pump removes residual refrigerant from said unit.

10. The unit of claim 7, wherein said valves are electromechanical.

11. A method of convertably recovering, recycling, and recharging a refrigerant containing device, comprising:

(a) providing a convertible refrigerant recovery, recycle, and recharge unit, comprising a control valve array, a vacuum pump, an oil separator, an oil-less compressor, a refrigerant identifier sensor, a primary storage tank, and a contaminated refrigerant storage tank;

said vacuum pump and said oil separator in flow communication with said control valve array;

said oil-less compressor in flow communication with said oil separator;

said one or more storage tanks in flow communication with said oil-less compressor;

said refrigerant identifier sensor (b) placing said control valve array in flow communication with said refrigerant containing device;

(c) activating said oil-less compressor to draw refrigerant from said refrigerant containing device to said one or more storage tanks;

(d) activating said vacuum pump to remove residual refrigerant from said unit;

(e) activating said refrigerant identifier sensor to detect contaminants in said unit and, if said contaminant are detected, selectively closing said primary storage tank and selectively opening said contaminated refrigerant storage tank.

12. The method of claim 11, wherein said refrigerant identifier sensor is in communication with one or more valves on each of said one or more storage tanks in order to control the opening and closing thereof.

13. The method of claim 11, wherein said control valve array comprises one or more valves to control the flow of refrigerant to said vacuum pump, said oil separator, said oil-less compressor, and said one or more storage tanks.

14. The method of claim 13, further comprising a pressure sensor in communication with said valves and adapted to control said valves based on detection of pressure.

15. The method of claim 14, wherein said pressure sensor is further in communication a vacuum pump valve in flow communication with said vacuum, wherein said pressure sensor is configured to activate said vacuum pump valve such that said vacuum pump removes residual refrigerant from said unit.

16. A convertible refrigerant recovery, recycle, and recharge unit, comprising:

a control valve array, a vacuum pump, an oil separator, and an oil-less compressor;

said vacuum pump and said oil separator in flow communication with said control valve array;

said oil-less compressor in flow communication with said oil separator;

said one or more storage tanks in flow communication with said oil-less compressor;

wherein said control valve array is adapted to receive refrigerant from a refrigerant containing device;

wherein said oil-less compressor is adapted to draw said refrigerant into one or more storage tanks; and wherein said unit is compatible with a plurality of refrigerant types without cross-contamination of said refrigerant.

* * * * *